US006557631B1

(12) United States Patent
Spencer et al.

(10) Patent No.: US 6,557,631 B1
(45) Date of Patent: May 6, 2003

(54) DOWN HOLE TENSION/COMPRESSION DEVICE FOR LOGGING TOOLS

(75) Inventors: Michael Charles Spencer, Melton Mowbray (GB); Harry Medlock, Grantham (GB)

(73) Assignee: Reeves Wireline Technologies, Ltd., Leicestershire (GB)

( * ) Notice: Subject to any disclaimer, the term of this patent is extended or adjusted under 35 U.S.C. 154(b) by 0 days.

(21) Appl. No.: 09/696,781

(22) Filed: Oct. 26, 2000

(30) Foreign Application Priority Data

Oct. 30, 1999 (GB) ..... 9925735

(51) Int. Cl.[7] ..... E21B 47/00; E21B 47/18; E21B 34/08

(52) U.S. Cl. ..... 166/250.13; 166/373; 166/153; 166/319

(58) Field of Search ..... 166/250.13, 255.1, 166/254.2, 373, 374, 381, 383, 386, 66, 153, 319

(56) References Cited

U.S. PATENT DOCUMENTS 3,367,179 A * 2/1968 Moore ..... 73/152.56
RE26,458 E * 9/1968 Moore ..... 73/152.56
3,686,943 A * 8/1972 Smith ..... 73/152.56
3,782,464 A 1/1974 Quichaud et al. ..... 166/224
3,942,373 A * 3/1976 Rogers ..... 166/255.1
4,059,167 A * 11/1977 Berryman ..... 175/297
4,105,070 A * 8/1978 Lavigne et al. ..... 166/250.13
4,508,174 A 4/1985 Skinner et al. ..... 166/373
5,259,456 A * 11/1993 Edwards et al. ..... 166/319
5,624,001 A * 4/1997 Evans ..... 166/178
5,636,694 A * 6/1997 Mireles et al. ..... 166/120
6,311,777 B1 * 11/2001 Milne et al. ..... 166/319

FOREIGN PATENT DOCUMENTS

GB 2077816 A 12/1981 ..... E21B/47/06

* cited by examiner

*Primary Examiner*—Thomas B. Will
*Assistant Examiner*—Jennifer H Gay
(74) *Attorney, Agent, or Firm*—Paul & Paul

(57) ABSTRACT

A self contained logging tool comprising electronic apparatus for logging a well is disclosed. This tool includes a normally open fluid flow valve structure being activated to operation by differential movement of drill pipe in which the logging tool resides. The valve structure operates to gradually close and thereby restrict the flow of fluid through the valve, which in turn restricts the flow of fluid within the drill pipe. This flow restriction results in increasing the back pressure within drill pipe to provide an indication at the surface that the logging tool is struck.

5 Claims, 10 Drawing Sheets

Shear pin fixing annular piston to outer tube
2427
1500 psi overpressure dump valve
500 psi pressure relief valve
2425
2401
2407
X
CT or drill
pipe X-over
Optional restrictor to provide detent
Bearing with internal vents
2423
2415
2401
2435
2411
2413
2405
2419
2431
2403
Flow cut-off vents
Logging
tool X-over
243
241
2421
Tension Piston/Bearing
2407
2433
Compression Piston/Bearing
2417
Flow Control Valve
Tension/Compression In Tension In Compression Safety Valve Release Steady State In Compression In Tension Safety Valve Blown

DOWN HOLE TENSION/COMPRESSION DEVICE FOR LOGGING TOOLS

BACKGROUND OF THE INVENTION

The present invention relates to down hole tension/compression devices and more particularly to devices for use with battery powered self contained logging tools employed in oil well drilling operations.

A problem which arises in such operations is that when a logging tool is deployed on the end of drill pipe or coiled tubing. If the logging tool becomes stuck in the borehole there is no indication at the surface that this has occurred in contrast to a logging tool connected by cable to the surface where the movement or non-movement of the cable will indicate movement or non-movement of the logging tool.

In the event that a self-contained logging tool becomes stuck movement of the drill pipe can result in damage to the tool.

SUMMARY OF THE INVENTION

It is an object of the present invention to provide a down hole tension/compression device which provides an early warning of when a tool is shuck to enable drill pipe motion to be halted, thereby preventing damage to the tool.

The present invention therefore provides a self contained logging tool comprising apparatus for logging a well, said tool including normally open fluid flow valve means, said valve means being operable when the drill pipe moves with respect to the logging tool to close and to restrict flow of fluid through said valve to thereby restrict the flow of fluid within said drill pipe, thereby creating back pressure within said drill pipe to provide an indication at the surface that the logging tool is stuck.

The present invention also provides a valve for use in a logging tool, said valve comprising an inlet and an outlet for fluid flow, said outlet comprising first and second overlapping slot means, said first overlapping slot means being operable as movement increases to move relative to said second overlapping slot means to progressively restrict the flow of fluid through said valve.

The present invention also provides a down hole device including a valve means as described above and further including poppet valve means operative to be actuated at an excessive pressure to provide a bypass flow route for said fluid. The present invention further comprises a method of operating a logging tool comprising the steps of connecting said logging tool to the end of a drill pipe, lowering said logging tool, on the end of said drill pipe, into a drill hole; and pumping mud down said drill pipe, said mud flowing through said logging tool via valve means situated within said logging tool;

said method comprising the further steps of detecting when said logging tool becomes stuck in the drill hole by detecting restriction of mud flow in the drill pipe caused by operation of said valve means, and on detection of such restriction halting movement of said drill pipe in said drill hole.

BRIEF DESCRIPTION OF THE DRAWINGS

Embodiments of the present invention will now be described, by way of example with reference to the accompanying drawings in which.

a) steady b) compression c) tension and d) safety valve blown

DETAILED DESCRIPTION OF THE INVENTION

Figure 1:
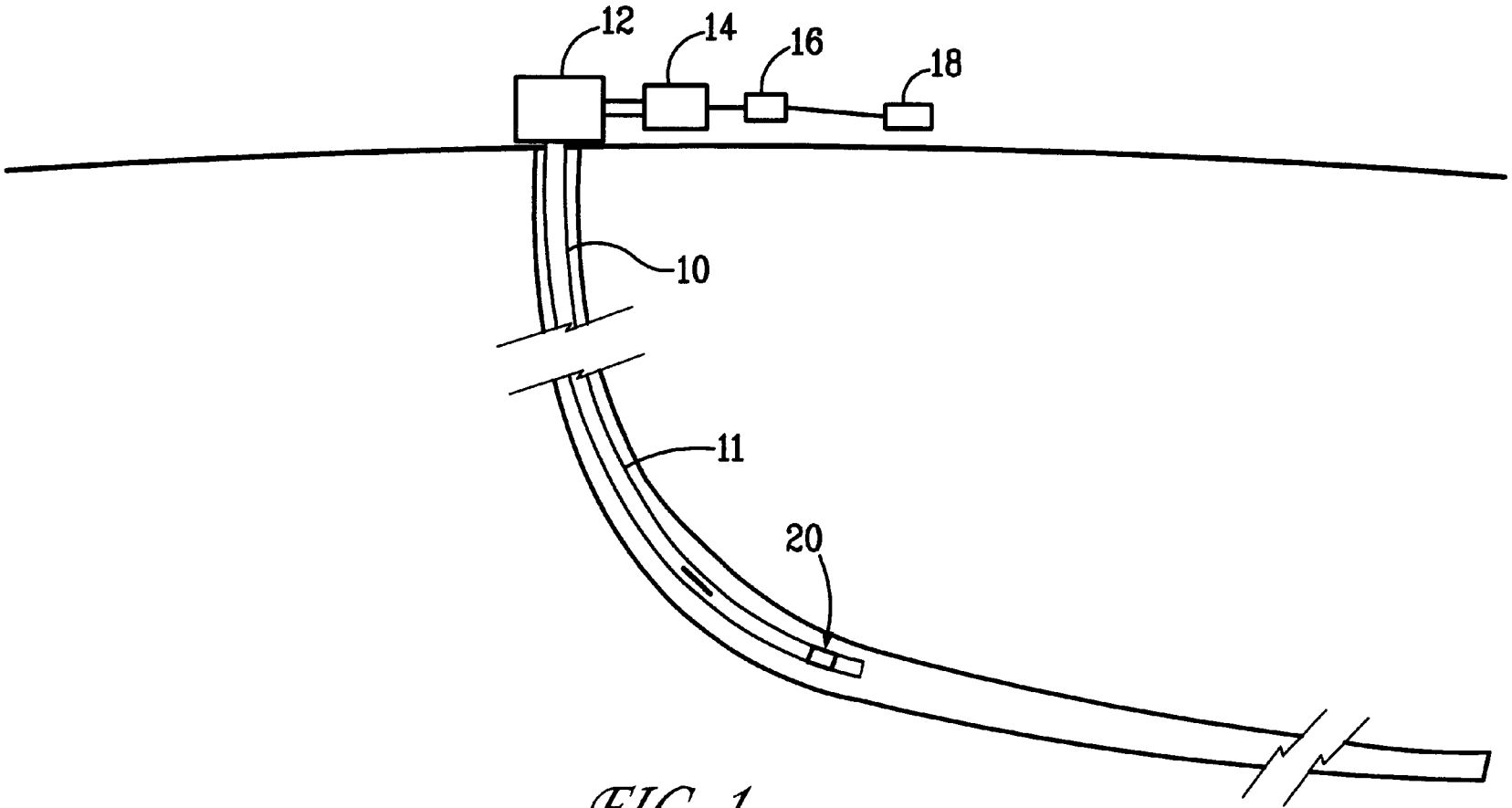
FIG. 1 shows diagrammatically an oil or gas drill pipe system including a self contained logging tool incorporating a down hole tension/compression device according to the present invention.

With reference now to FIG. 1, a drill hole 10 which may, for example, be an exploratory drilling for an oil or gas field is schematically shown. A drilling rig or head 12 is shown which is provided with pump means 14 which pumps mud down the drill pipe in known manner.

The pump means 14 will be provided with pressure measurement means 16 for measuring the pressure of the mud mixture in the drill pipe 11. The pressure measurement means is provided with control means 18 for controlling the pump 14 to regulate the pressure of the mudflow.

A battery powered self contained logging tool 20 is shown at an exemplary position in the drill pipe 11. In known manner this tool 20 is used for logging the properties of the well. The operation of the logging tool in logging these properties will not be described further in this application.

A problem with such self-contained logging tools is that they are not connected in any manner to the surface. The movement of the tool within the drill hole is executed solely by moving the drill pipe upwards or downwards.

However because the logging tool is self-contained its movement along the drill hole cannot be monitored by movement of an attached cable. Thus if the tool becomes stuck in the drill hole this will not be immediately detected.

Continued motion of the drill pipe to force the tool past an obstruction can result in damage to the tool. The present invention provides a means for avoiding such damage by providing an indication at the surface if the tool becomes lodged in the hole.

Figure 2:
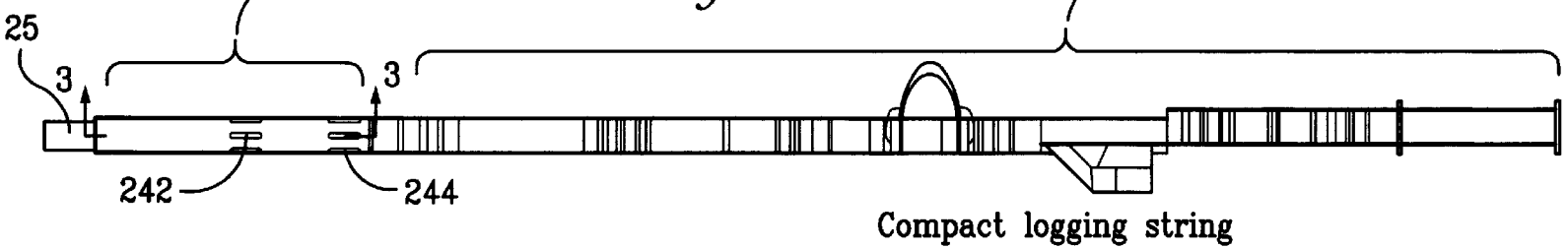
FIG. 2 shows a battery powered self contained logging tool according to the present invention.

With reference now to FIG. 2, the tool 20 comprises a first logging section 22 and a second valve section 24. As stated the logging section 22 is not part of the present invention and may comprise conventional logging electronic circuitry. The valve section 24 comprises a generally cylindrical elongate tubular assembly which is rigidly attached to the logging portion 22 to comprise the logging tool string. The assembly 24 includes slotted outlet holes 2422, 244 for the flow of mud, the purpose of which will be explained with reference to FIGS. 3 to 6 which describe the valve section 24 in greater detail. The portion 25 is connected directly to the C.T. (coiled tubing) or drill pipe.

Figure 3:
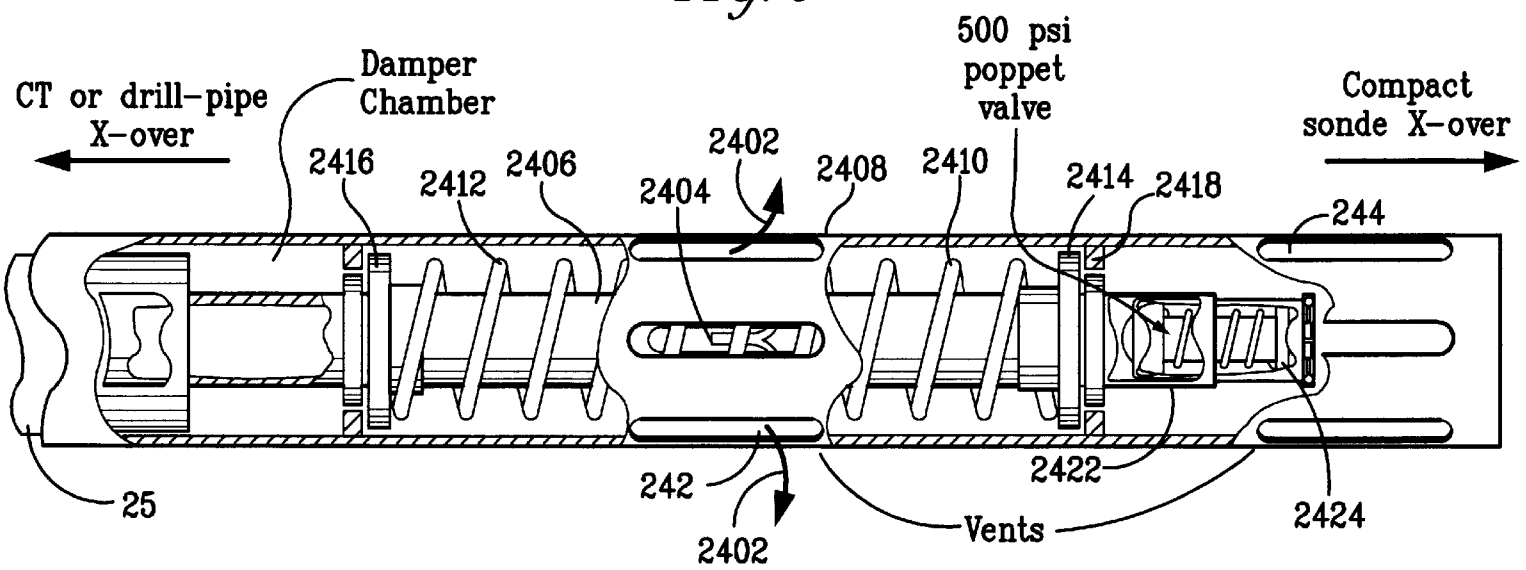
FIG. 3 shows a mud pressure operated down hole tension and compression tool in accordance with the present invention in a neutral, non-operative condition.

With reference now to FIG. 3, the valve section 24 comprises a mud pressure operated down hole tension and compression tool which is actuated by mud pressure. The normal mudtlow is indicated by arrows 2400 and 2402, the path of which is via internal slotted holes 2404 in a hollow piston member 2406.

The piston member 2406, attached to portion 25, is constrained to move within an external tube member 2408 by springs 2410, 2412 acting against collars 2414, 2416 which are in turn restricted in final movement by internal flanges 2418, 2420 attached to tube member 2408.

At the right-hand end of hollow piston member 2406 a poppet valve 2422 is mounted. This valve is provided with shear pin means 2424. For example, the poppet valve may be designed to open at a pressure of 500 psi and the shear pins may be rated at 1500 psi. The poppet valve/shear pin assembly provides a final safety flow path as described hereinafter.

Figure 4:
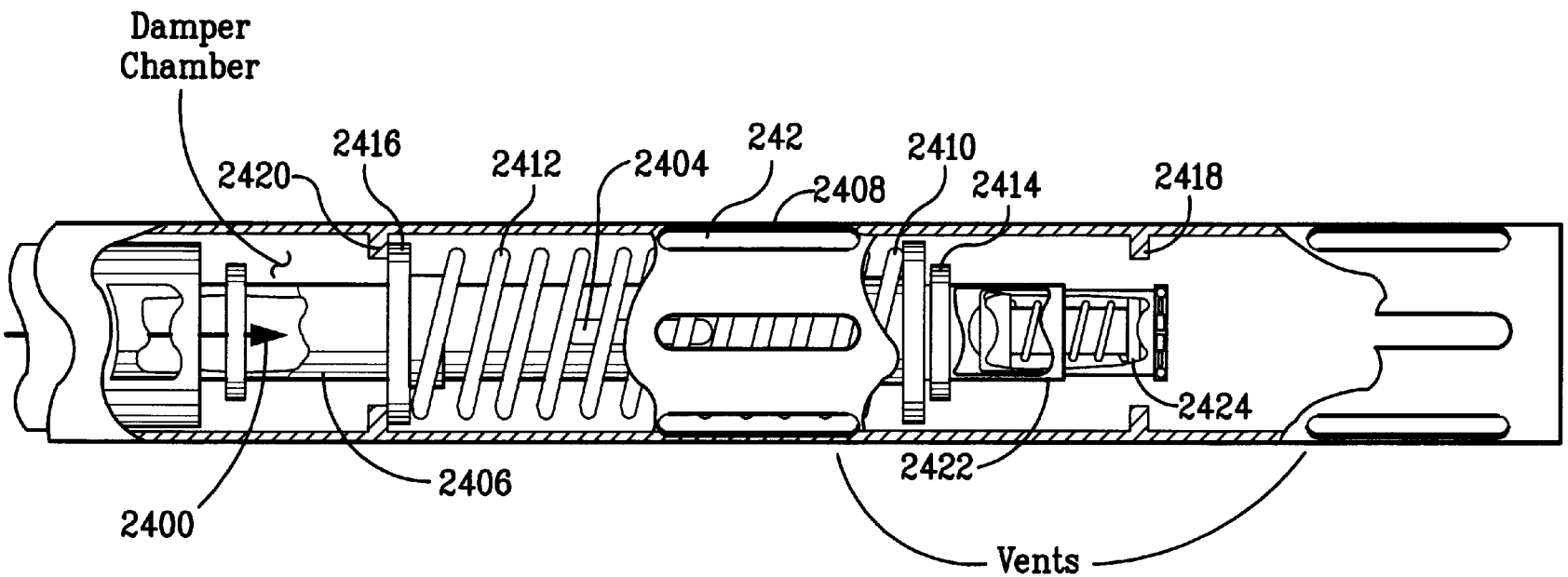
FIG. 4 shows the tool of FIG. 3 in a tension condition illustrating the further operation of the valve means.

With reference to FIG. 4 the tension/compression tool device is shown in tension with restricted mudflow through the centre slotted holes 242. This restricted flow is caused by movement of collar 2414 when the tool 20 becomes stuck either completely or partially in the drill pipe. This causes spring 2412 to be compressed and piston 2406 to move to the left in FIG. 4. This causes the slots 2404 and 242 to be only partially aligned and thereby restricts the flow of mud through the centre slots 242.

This restriction will cause an increase in pressure of mud within the drill pipe, which increase is detectable at the surface and thereby indicates that the logging tool has become completely or partially stuck.

Figure 5:
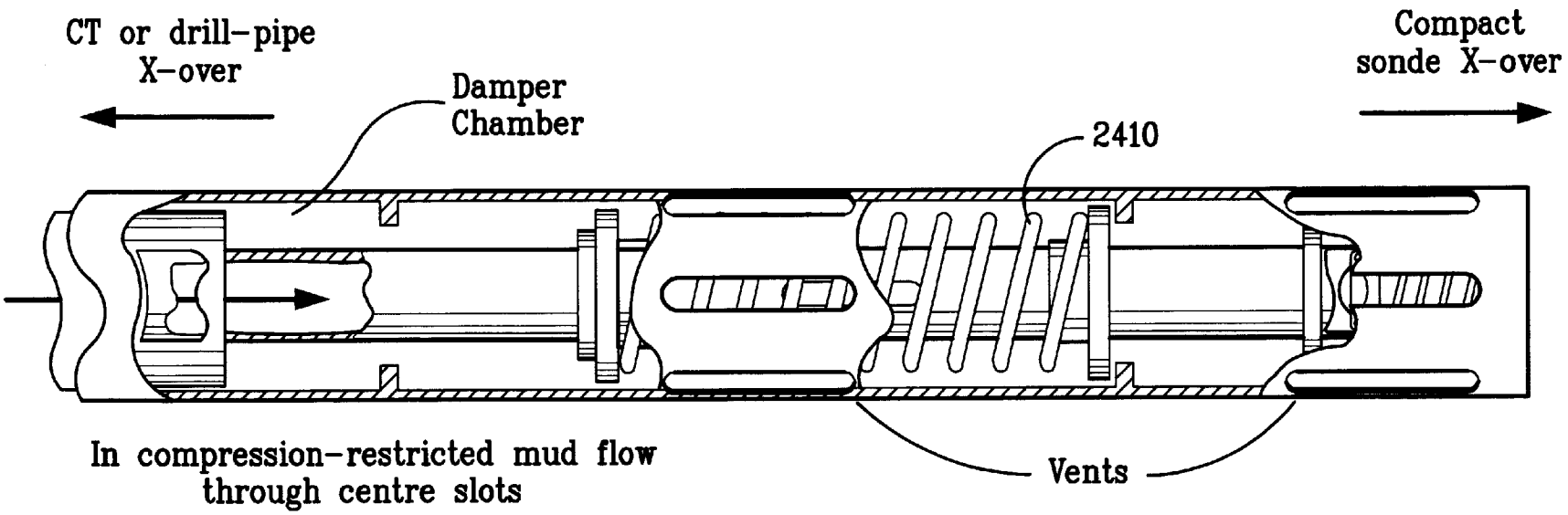
FIG. 5 shows the tool of FIG. 3 in a compression condition illustrating the further operation of the valve means.

FIG. 5 shows the tension and compression tool device in compression with restricted mud flow through centre slots, illustrating that compression of spring 2410 against collar 2414 will also cause the centre slot 242 to become restricted and thereby create a build up of mud pressure which will be detectable at the surface, thereby indicating that the logging tool has become partially or completely stuck.

With reference now again to FIGS. 4 and 5, in the event that the tool becomes completely stuck and the pressure build up continues, the poppet valve 2422 will open allowing mud to flow through the hollow piston 2406, through the poppet valve 2422 and out through outer vents 244.

Figure 6:
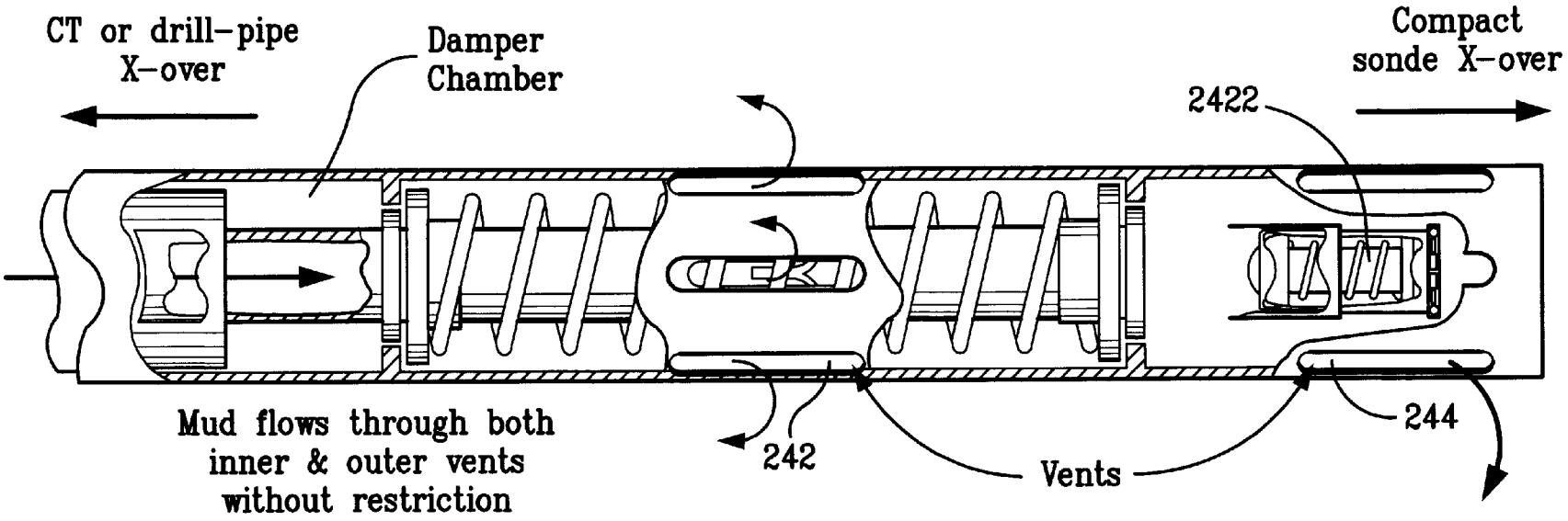
FIG. 6 shows the tool of FIG. 3 in a further condition illustrating release of the poppet valve.

Should the poppet valve 2422 fail then this valve is provided with shear pins 2424 which will release the valve from its mounting, as shown in FIG. 6 so that the mud can flow through the hollow cylindrical piston. Otherwise, mud flows through both inner and outer vents without restriction.

The present invention therefore provides a method of detecting, when a self contained logging tool becomes lodged in a drill hole, as defined, and therefore, by constricting the mud flow and causing a detectable change in the mud pressure to occur, allowing action to be taken to prevent damage to the logging tool. With reference now to FIGS. 4 and 5, the slotted holes 2404, 242 are shown with dimensions that ensure that they completely overlap in the unoperated condition and just completely close when the springs are completely compressed.

However, by designing the springs to be more elongate or, alternatively, the slots to be shorter in length, the valve may be completely closed well in advance of the springs being completely compressed. This enables detection of the lodging of the tool in the drill hole before the springs are completely compressed, thereby enabling the withdrawal or insertion of the drill pipe to be stopped in advance of final compression of the springs, thereby providing an elastic stop for the logging tool, thereby further preventing damage to the tool.

Figure 7:
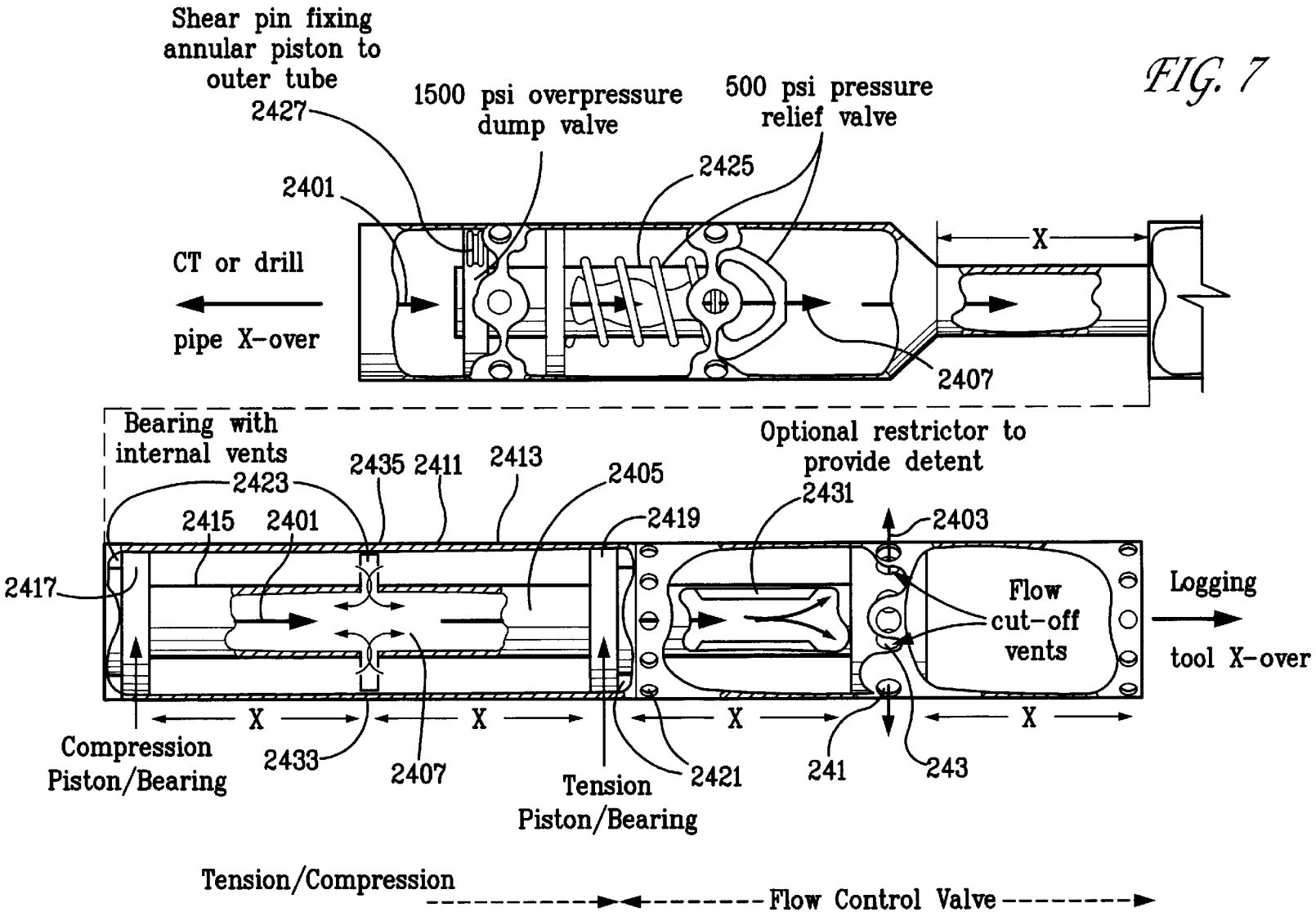
FIG. 7 shows an alternative embodiment of the down hole compression and tension tool.

With reference now to FIG. 7, in a second embodiment the valve section 24 also comprises a generally cylindrical elongate tubular assembly which is rigidly attached to the logging portion 22 to comprise the logging tool string. The assembly 24 includes an outlet path via holes 241, 243 for the flow of mud, the purpose of which will be explained with reference to FIGS. 8 to 11 which describe the valve section 24 in greater detail.

The valve section 24 comprises a mud pressure operated down hole tension and compression tool. The normal mudflow is indicated by arrows 2401 and 2403, the path of which is via internal holes 241 in a hollow piston member 2405.

The piston member 2405 also incorporates sliding pistons 2417, 2419 constrained to move within an external tube member 2411 by mud pressure acting in chambers 2413, 2415 which acts against pistons 2417, 2419 which are in turn restricted in final movement by internal flanges 2421, 2423 attached to tube member 2411. When the device is in its rest position the pistons 2417 and 2419 are at the outer ends of the chamber and the holes 241, 243 align, allowing mud to flow into the drill hole.

At the left-hand end of hollow piston members 2405 a hollow poppet valve 2425 is mounted. This valve is provided with shear pin means 2427. For example, the poppet valve may be designed to open at a pressure of 500 psi and the shear pins may be rated at 1500 psi. The poppet valve/shear pin assembly provides a final safety flow path as described hereinafter. In further reference to FIG. 7, shear pin(s) 2427 fixing the annular piston to the outer tube are located adjacent the drill pipe cross over end (up hole) of the tool. These shear pin(s) 2427 implement a 1500 psi overpressure dump valve. On the down hole side is the 500 psi pressure relief valve implemented with the hollow poppet valve 2425. The compression piston bearing 2417 and the tension piston bearing 2419 are located on either side of bearing supported internal flanges (vents) 2423. An optional restrictor 2431 to provide a detent is down hole in the tool adjacent the flow cut-off vents 243, 2403.

A further bearing 2433, with internal vents is provided to support piston member 2405.

Figure 8:
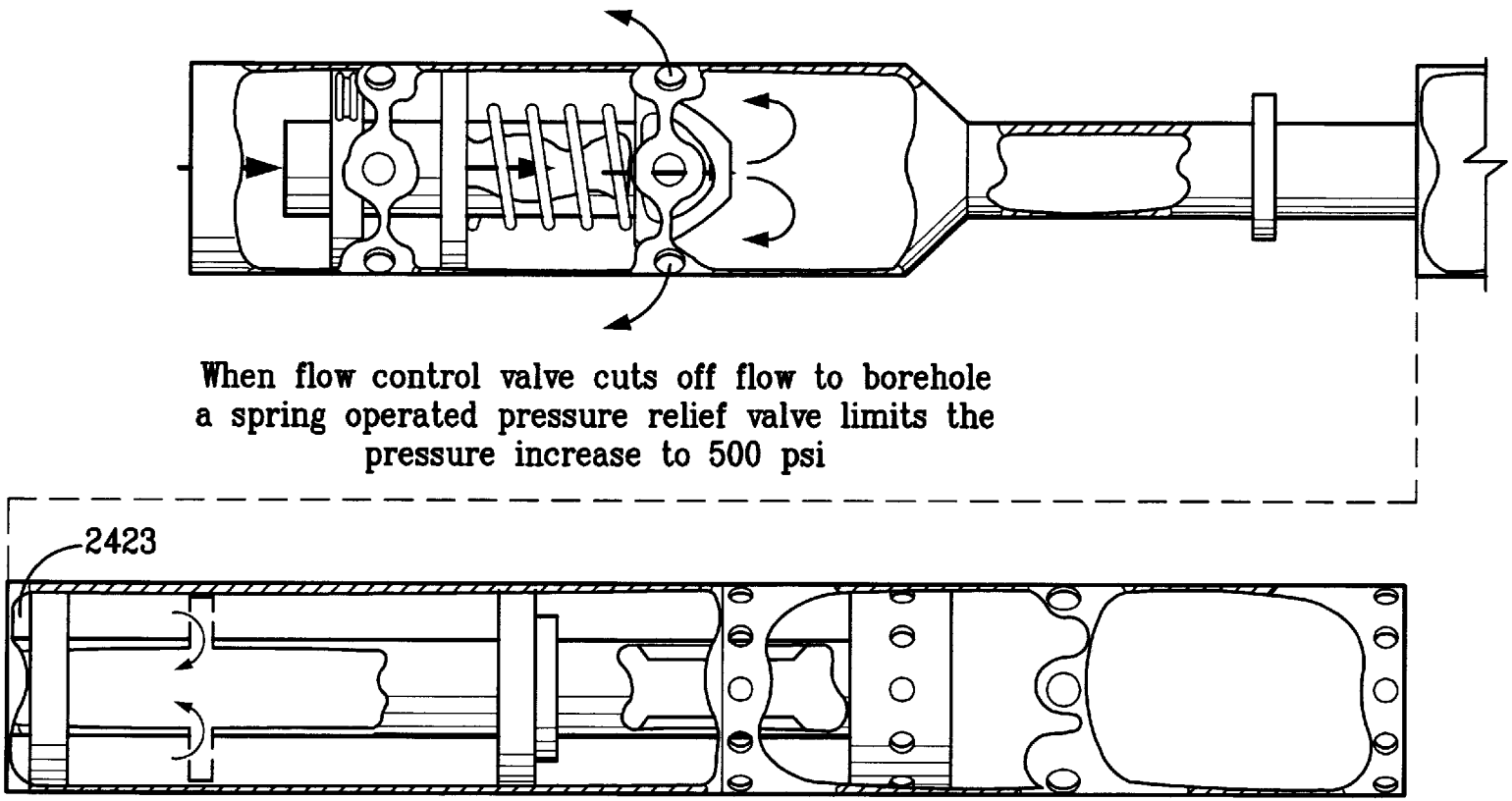
FIG. 8 shows the tool of FIG. 7 in a tension condition.

With reference to FIG. 8, the tension/compression tool device is shown in tension with mud flow restricted by the misalignment of holes 241, 243 and piston member 2405 displaced from its rest position. This restricted flow is caused by movement of the hollow piston means 2405 when the tool 20 becomes stuck either completely or partially in the drill hole. The force applied to the logging tool is now controlled by the force on the left-hand piston 2417 applied by the mud pressure in the chamber 2415, which, in turn, is limited by the pressure required to operate the poppet valve 2425. When the flow control valve cuts off flow to the borehole, the spring operated relief valve limits the pressure increase to 500 psi.

The restriction will cause an increase in pressure of the mud within the drill pipe, which increase is detectable at the surface and thereby indicates that the logging tool has become completely or partially stuck. The tensional load on the tool equals about 1000 lbs. With the flow cut off vents closed, a pressure increase of 500 psi is recorded at the surface over the full 2 foot stroke. This two foot stroke is marked by the "X" dimension lines shown in FIG. 7.

Figure 9:
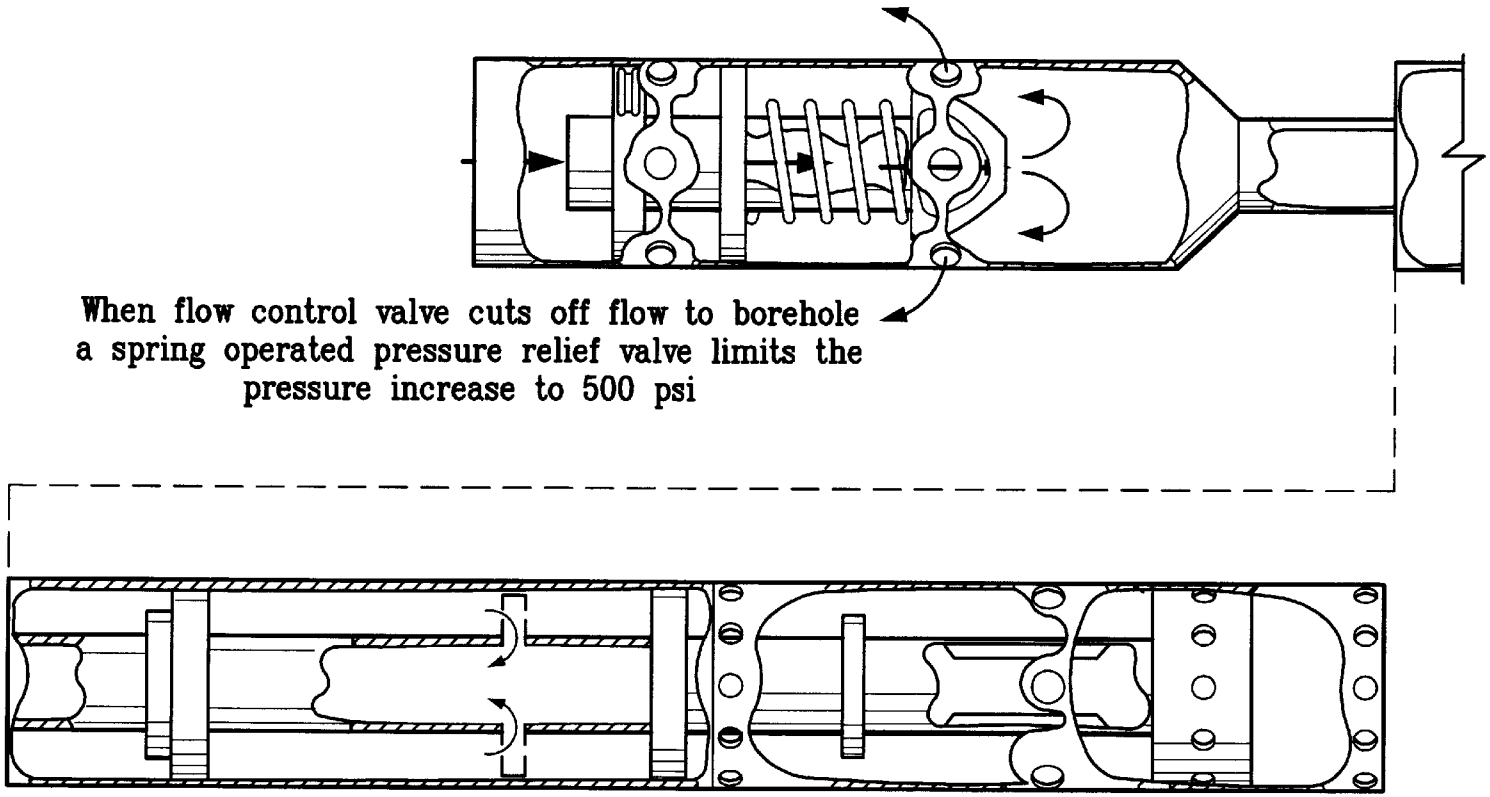
FIG. 9 shows ~e tool of FIG. 7 in a compression condition.

FIG. 9 shows the tension and compression tool device in compression, illustrating the misalignment of holes 241, 243 which will also cause the flow to become restricted and thereby create a build-up of mud pressure which will be detectable at the surface, thereby indicating that the logging tool has become partially or completely stuck. The force on the logging tool is now controlled by the pressure in chamber 2413 acting on the right-hand piston 2419.

Figure 10:
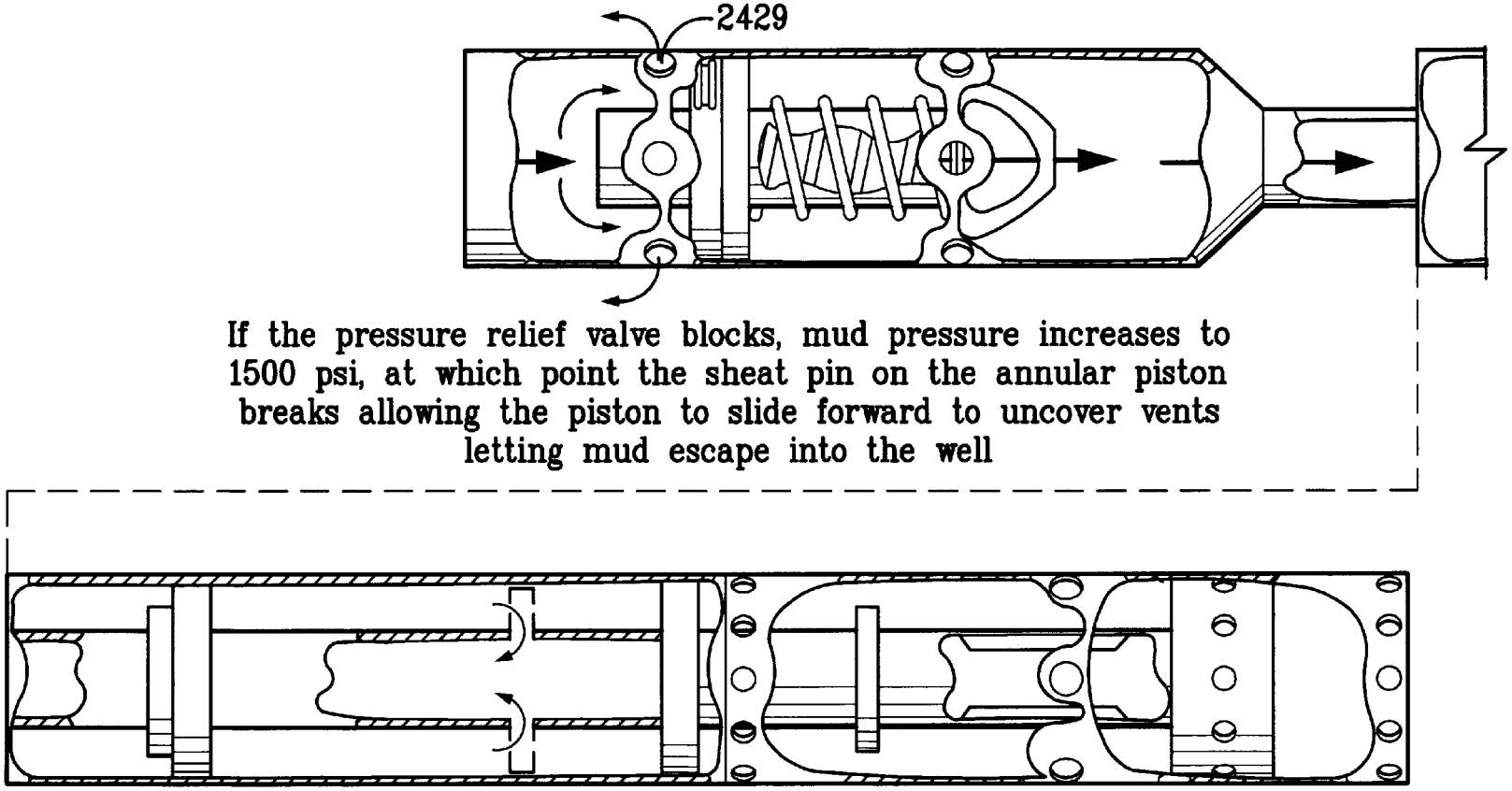
FIG. 10 shows the tool of FIG. 7 illustrating the safety valve release.

With reference now to FIG. 10, in the event that the tool becomes completely stuck and the pressure build-up continues, the shear pin 2427 will break allowing piston 2426 in the poppet valve assembly to shift, permitting mud to flow to the drill hole through the vents 2429, without restriction.

An internal constriction 2431 is also provided so that a modest pressure (say 100 psi) is developed in the chamber so that this needs to be overcome before any displacement at all can take place. If the pressure relief valve blocks, mud pressure increases to 1500 psi, at which point the shear pin on the annular piston breaks allowing the piston to slide forward to uncover the vents letting mud escape into the well.

With reference to FIG. 11, for ease of understanding the tension/compression tool of the embodiment of FIG. 7 is shown in all four conditions. In the condition shown in FIG. 11A the tension/compression tool is in the steady state condition. In FIG. 11B the tool is in its compression condition.

Figure 11A:
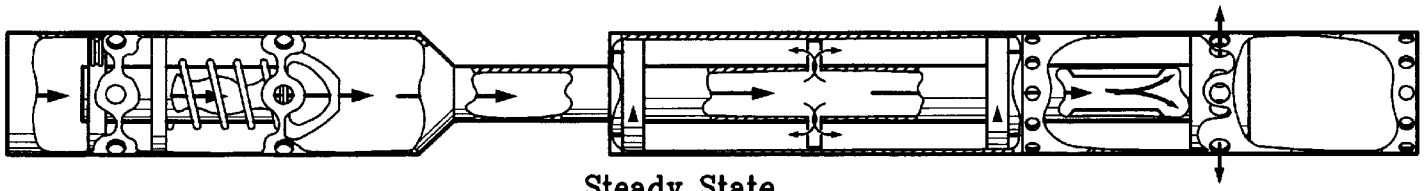
FIG. 11 shows the tool of FIG. 7 in its several states.
Figure 11B:
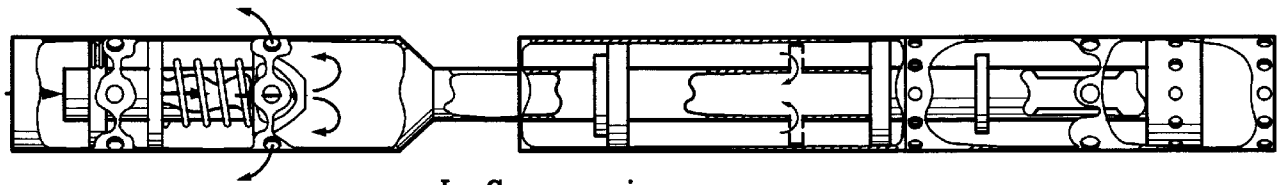
Figure 11C:
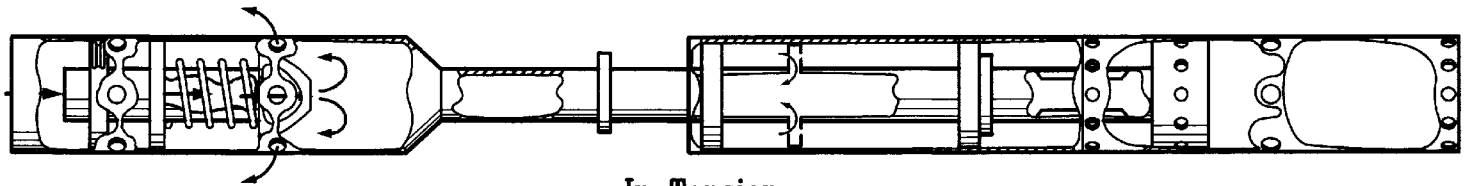
Figure 11D:
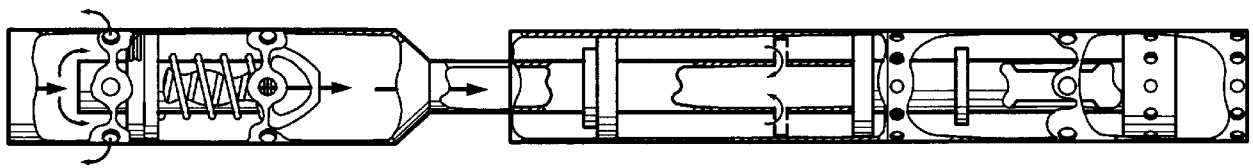

In FIG. 11C the tool is in its tension condition and in FIG. 11D the tool is shown with the safety piston 2426 blown.

The present invention therefore provides a method of detecting when a self contained logging tool becomes lodged in a drill hole, as defined, and therefore, by constricting the mud flow, causing a detectable change in the mud pressure to occur, allowing action to be taken to prevent damage to the logging tool.

What is claimed is:

1. A self contained well hole logging tool comprising electronic apparatus for logging a well hole, said well hole having a drill pipe therein, wherein said logging tool includes normally open fluid flow valve structure, said valve structure being operable to close upon a differential movement of said drill pipe longitudinally to said logging tool and thereby to restrict flow of fluid through said valve structure to thereby restrict the flow of fluid within said drill pipe, thereby creating a back pressure within said drill pipe to provide an indication at the surface that the fogging tool is stuck in the hole.

2. The self contained logging tool as claimed in claim 1 in which said valve structure includes a piston located inside an outer cylinder and a spring associated therewith, said piston being constrained to be located at a first position relative to said outer cylinder by said spring, said piston having connection means associated therewith for connecting said piston to said drill pipe; and wherein said outer cylinder is connected to said electronic well logging apparatus.

3. The self contained logging tool as claimed in claim 1 in which said valve structure includes a piston located inside an outer cylinder and a mud pressure responsive structure associated therewith, said piston being constrained to be located at a first position relative to said outer cylinder by said mud pressure responsive structure, said piston having connection means associated therewith for connecting said piston to said drill pipe and wherein said outer cylinder is connected to said electronic well logging apparatus.

4. A down hole compression/tension device, for operation in a fluid containing well hole having a drill pipe therein, including a valve structure having a piston located inside an outer cylinder and being biased to a first position, said piston also having a fluid connection to said drill pipe, and wherein said outer cylinder is connectable to electronic apparatus outside of said well hole; and further including poppet valve operative to be actuated at an excessive pressure to provide a bypass flow route for said fluid away from said valve structure piston.

5. A method of operating a well hole logging tool comprising the steps of connecting said logging tool to the end of a drill pipe, lowering said logging tool on the end of said drill pipe into a drill hole, pumping mud down said drill pipe, said mad flowing through said logging tool via a valve structure situated within said logging tool;

said method comprising the further steps of detecting when said logging tool becomes stuck in the drill hole by detecting restriction of mud flow in the drill pipe, caused by operation of said valve means, and on detection of such restriction halting movement of said drill pipe in said drill hole.

* * * * *